United States Patent [19]

Pollington

[11] 4,341,046

[45] Jul. 27, 1982

[54] TOOL GRIND FIXTURE

[76] Inventor: Bernard M. Pollington, 110 6th St., Marion, Mich. 49665

[21] Appl. No.: 180,825

[22] Filed: Aug. 25, 1980

[51] Int. Cl.[3] ..... B24B 3/22

[52] U.S. Cl. ..... 51/225

[58] Field of Search ..... 51/229, 225, 216 H

[56] References Cited

U.S. PATENT DOCUMENTS

| | | | |
|---|---|---|---|
| 2,530,421 | 11/1950 | Burness | 51/229 |
| 2,700,854 | 2/1955 | Detron | 51/216 H |
| 2,710,498 | 6/1955 | Rocheleau | 51/225 |
| 3,349,521 | 10/1967 | Bryant | 51/225 |
| 3,486,044 | 10/1949 | Lusk | 51/225 |
| 3,688,452 | 9/1972 | Stevens | 51/229 |
| 3,722,148 | 3/1973 | Grahn | 51/225 |
| 3,820,286 | 6/1974 | Burch | 51/225 X |
| 4,004,377 | 1/1977 | Laudick | 51/225 |
| 4,134,235 | 1/1979 | Maharidge | 51/225 X |

*Primary Examiner*—Harold D. Whitehead

*Attorney, Agent, or Firm*—Gifford, VanOphem, Sheridan & Sprinkle

[57] ABSTRACT

A tool sharpening fixture is provided which is particularly suited for sharpening rotary cutting tools. The tool sharpening fixture comprises a housing having a throughbore and a bushing rotatably mounted in the housing throughbore and having an eccentric axial bore formed through its. An elongated cylindrical member is inserted through the bushing eccentric bore so that the elongated member extends outwardly from each end of the housing. The cutting tool to be sharpened is removably mounted at one end of the elongated member while the opposite end of the elongated member can be grasped by the hand of the user. An indexing ring is secured to the bushing and locks the elongated member to the bushing in at least two predetermined rotational positions. Typically, the number of indexing positions is the same as the number of cutting edges on the tool to be sharpened. A stop ring is also rotatably mounted to the housing and lockable at any desired rotational position. The stop ring includes two stop members which cooperate with a stop tab on the bushing to limit the rotation of the bushing and the elongated cylindrical member between two preselected rotational positions.

8 Claims, 8 Drawing Figures

TOOL GRIND FIXTURE

BACKGROUND OF THE INVENTION

I. Field of the Invention

The present invention relates generally to tool sharpening fixtures and, more particularly, to such a fixture particularly adapted for sharpening rotary cutting tools.

II. Description of the Prior Art

There are a number of special rotary cutting tools which are used in machining operations and which are specially constructed for a particular operation. Such cutting tools typically comprise two or more cutting edges having a predetermined radial and/or axial relief and with a flute extending between adjacent cutting edges.

After the use of the cutting tool in machining operations, the cutting tools become dull and require either sharpening or replacement. Most machine shops which utilize such special cutting tools, however, do not have the proper equipment to sharpen these cutting tools when they become dull since it is necessary to sharpen these tools so that the cutting edges have the proper radial and axial relief for their proper cutting action. Consequently, when these cutting tools become dull it has been the previous practice to either discard the cutting tool or to send the cutting tool to a special shop having the equipment necessary to regrind or sharpen the cutting tools and still retain the proper axial and radial relief on the cutting edges.

The previous practice of discarding the dull cutting tool and replacing it with a new one is unduly expensive. Sending the dull cutting tool to a shop having the equipment necessary to resharpen the cutting tool with the proper radial and axial relief is less expensive than the total replacement of the cutting tool but often times requires a prolonged period of time before the sharpened cutting tool is returned to the user. When a particular cutting tool is required to finish a particular job, the time required to have a dull cutting tool sharpened oftentimes results in unsatisfactory delays in completing the job.

There have, of course, been a number of previously known tool sharpening fixtures which are designed to hold and rotate a cutting tool to sharpen the cutting edges, typically by grinding the outer periphery of the cutting edges. Some of these previously known sharpening fixtures have also included means for varying the axial and/or radial relief on the cutting edges of the tool.

These previously known tool sharpening fixtures, however, are unduly complex and expensive in construction. For many machine shops or the like which require only occasional resharpening of their special cutting tools, these previously known fixtures are economically infeasible. For this reason, many machine shops still either discard their dull cutting tools or send their dull tools to machine shops with special equipment for resharpening these tools.

SUMMARY OF THE PRESENT INVENTION

The present invention provides a tool sharpening fixture for sharpening cutting tools which is inexpensive in construction and yet capable of producing variable axial and radial relief on the cutting edges of the tool.

In brief, the cutting tool sharpening fixture according to the present invention comprises a housing having a throughbore. An bushing having an eccentric axial throughbore is rotatably mounted within the housing while an elongated cylindrical member is axially slidably mounted within the bushing throughbore between an extended and retracted position so that in its extended position a portion of the elongated member extends outwardly from each axial end of the housing. A tool holder is formed at one end of the elongated member for holding the tool to be sharpened generally coaxial with the elongated cylindrical member.

A tubular and cylindrical indexing ring is removably attached to the bushing so that the indexing ring is positioned coaxially around a part of the elongated cylindrical member. The indexing ring furthermore includes a plurality of circumferentially spaced and axially extending slots equal in number to the number of cutting edges on the cutting tool to be sharpened. A radially extending alignment pin on the elongated member can be selectively positioned within any of the slots on the indexing ring when the elongated member is in its extended position so that the indexing ring and elongated member are rotationally locked together. Thus, the elongated cylindrical member can be positioned in its extended position at only a predetermined number of rotational positions corresponding to the number of slots in indexing ring. In order to move the elongated member from one rotational position into its next rotational position, the elongated member must be moved to its retracted position until the radial pin in the elongated member is positioned outside the indexing ring slot. Thereafter, the elongated member can be rotated to its next rotational position in which the radial pin on the elongated member is aligned with the next slot in the indexing ring and then moved to its extended position.

A stop ring is rotatably mounted to the housing adjacent the indexing ring and includes a pair of circumferentially spaced stop members protruding outwardly from it. The stop ring can be rotated to any desired position with respect to the housing and then locked to the housing by a suitable means, such as a set screw. A stop tab is also secured to the bushing and is positioned between the stop members on the stop ring so that the stop ring limits the rotation of the bushing, and also the elongated member when in its extended position, between two predetermined rotational positions.

In operation, a cutting tool to be sharpened is secured at one end of the elongated member and the elongated member is inserted through the bushing eccentric bore and to its extended position. The elongated member is then rotated between the predetermined rotational positions established by the stop ring in unison with the bushing and so that a cutting edge on the cutting tool engages and is sharpened by a rotating grinding wheel which is radially aligned with the cutting tool. After the cutting edge has been sharpened, the elongated member is moved to its retracted position, thus moving the cutting tool out of radial alignment from the grinding wheel, and the elongated member is then rotated to its next rotational position with respect to the indexing ring. The elongated member is then again moved to its extended position so that the cutting tool is again radially aligned with the grinding wheel. Rotation of the elongated member between the two rotational positions thus sharpens the next cutting edge on the cutting tool and this procedure is repeated for each cutting edge of the cutting tool.

The eccentric bore in the bushing in conjunction with the adjustable stop ring which controls the extent of rotation of the elongated member enables adjustment of the radial relief to which the cutting edge is sharpened. In addition, a housing includes a main body portion and a base portion and these housing portions are pivotally adjustably connected together to provide adjustable axial relief when sharpening the cutting tool edges.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
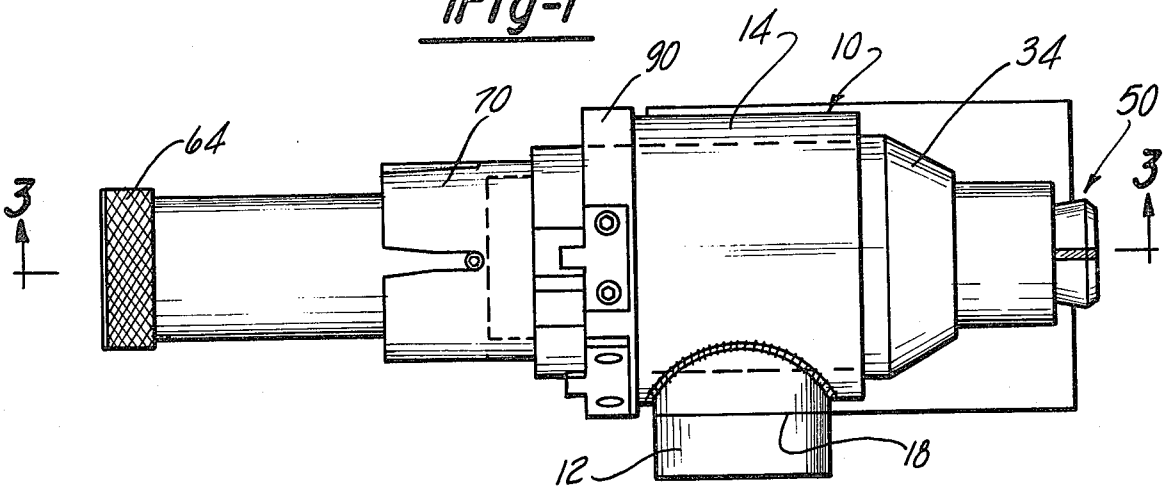
FIG. 1 is a top plan view of a preferred embodiment of the tool sharpening fixture according to the present invention.
Figure 2:
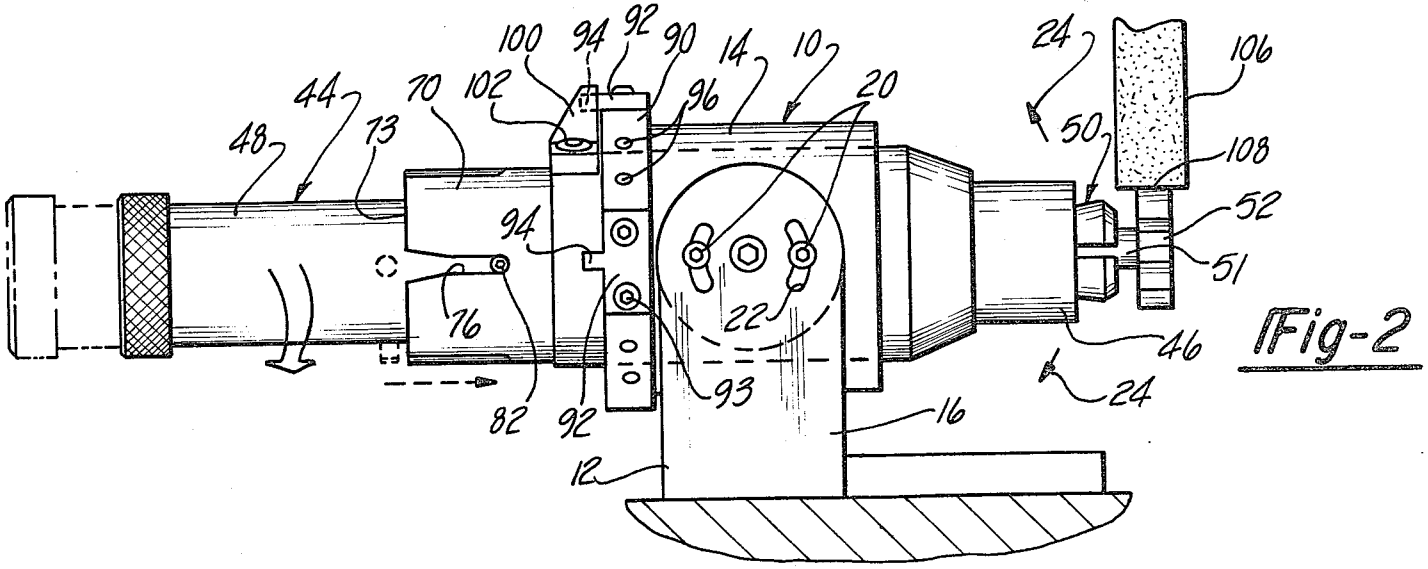
FIG. 2 is a side view of the preferred embodiment of the tool sharpening fixture of the present invention.
Figure 3:
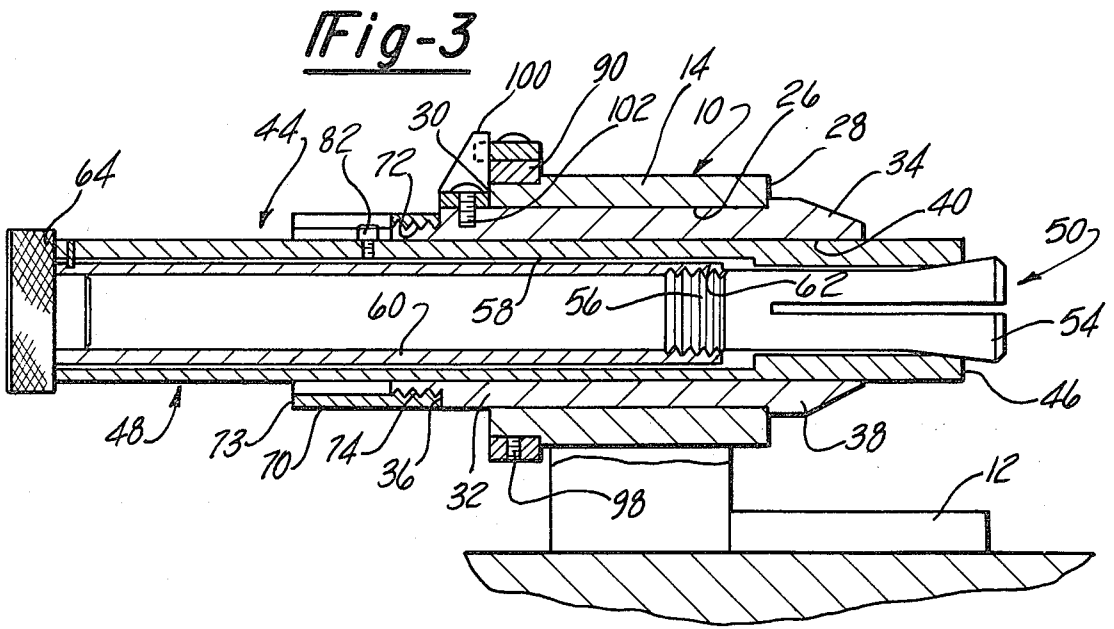
FIG. 3 is a sectional view taken substantially along line 3—3 in FIG. 1.

With reference first to FIGS. 1–3, a preferred embodiment of the tool sharpening fixture according to the present invention is thereshown and comprises a housing 10 having a base 12 and a tubular cylindrical main body 14. The base 12 includes an upwardly extending support 16 which flatly abuts at its upper end against a surface 18 on the main body 14. As is best shown in FIG. 2, the upright support 16 is secured to the surface 18 of the main body 14 by bolts 20 which are positioned through arcuate slots 22 in the upright support 16. The bolts 20 and arcuate slots 22 permit the main body 14 to pivot with respect to the base 12, as indicated by arrows 24, and, when pivoted to the desired position, tightening the bolts 20 locks the housing base 12 and main body 14 together. The purpose of the pivotal connection between the housing base 12 and the main body 14 will be subsequently described.

Still referring to FIGS. 1–3, the housing body 14 includes a throughbore 26 which is open at both the front end 28 and rear end 30 of the housing body 14. A generally cylindrical bushing 32 is positioned within the housing bore 26 so that the bushing 32 can rotate within the housing bore 26. A front end or portion 34 of the bushing 32 protrudes outwardly from the front end 28 of the housing body 14 while, similarly, a rear end or portion 36 of the bushing 32 protrudes outwardly from the rear end 30 of the housing body 14. In addition, the bushing 32 includes any conventional means, such as a lock ring or enlarged diameter portion 38 on the bushing 32, to lock the bushing 32 against axial movement with respect to the housing body 14.

Figure 4:
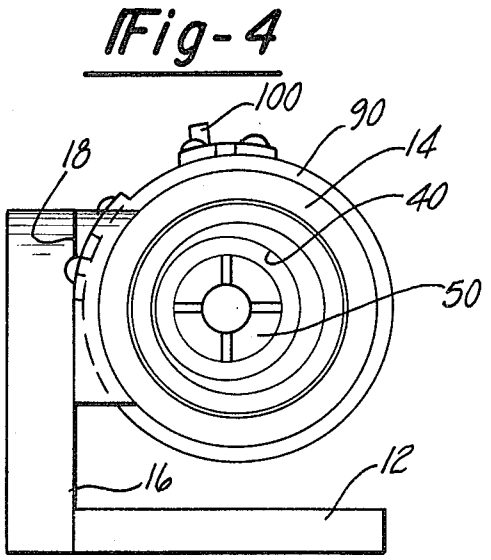
FIG. 4 is an end view of the preferred embodiment of the sharpening fixture of the present invention.

Referring now particularly to FIGS. 3 and 4, a throughbore 40 is formed axially through the bushing 32. The throughbore 40, however, is radially offset or eccentric to the axis of rotation of the bushing 32 for a reason to be subsequently described.

Referring now particularly to FIGS. 2 and 3, an elongated cylindrical member 44 is axially slidably positioned within the bushing throughbore 40 so that a front end 46 of the elongated member 44 protrudes outwardly from the front end 34 of the bushing 32 and, likewise, a rear portion 48 of the elongated member 44 protrudes outwardly from the rear end 36 of the bushing 32. The elongated member 44 includes any conventional means 50 for holding a cutting tool 52 (FIG. 2) coaxial with the elongated member 44 and at its front end 46. As shown, however, the holding means comprises a flared collet 54 having a threaded end 56 positioned within an axial throughbore 58 in the elongated member 44. A tightening tube 60 extends through the axial bore 58 and has a threaded end 62 which threadably engages with the threaded end 56 of the collet 54. The opposite end of the tightening tube 60 is coupled to a knob 64 at the rear end of the elongated member 44. Thus, with the shank 51 (FIG. 2) of the cutting tool 52 positioned in the collet 54, rotation of the knob 64 draws the collet 54 into the elongated member throughbore 58 thus clamping the collet 54 around the cutting tool shank 51 and rigidly securing the cutting tool 52 to the elongated member 44.

Referring now to FIGS. 2 and 3, a tubular and cylindrical indexing ring 70 has a threaded end 72 which threadably engages a threaded portion 74 on the rear end of the bushing 32. The indexing ring 70 includes a plurality of circumferentially equidistantly spaced and axially extending slots 76 around its periphery. Each slot is open through the opposite or rear end 73 of the indexing ring 70.

With reference now to FIGS. 3, 5, 6 and 7, the number of slots 76 in the indexing ring 70 is equal to the number of cutting lobes 80 on the cutting tool 52 which is to be sharpened and wherein each lobe 80 has an outer cutting edge 81. For example, the indexing ring 70 shown in FIG. 5 would be used to sharpen a cutting tool having four lobes 80 such as the cutting tool illustrated in FIG. 7. Similarly, the indexing ring shown in FIG. 6 will be used to sharpen cutting tools 52 having only three lobes 80. Indexing rings 70 having different numbers of slots 76 can, of course, be interchanged merely by unscrewing the indexing ring 70 from the bushing 32 and replacing it with a different indexing ring 70.

Figure 8:
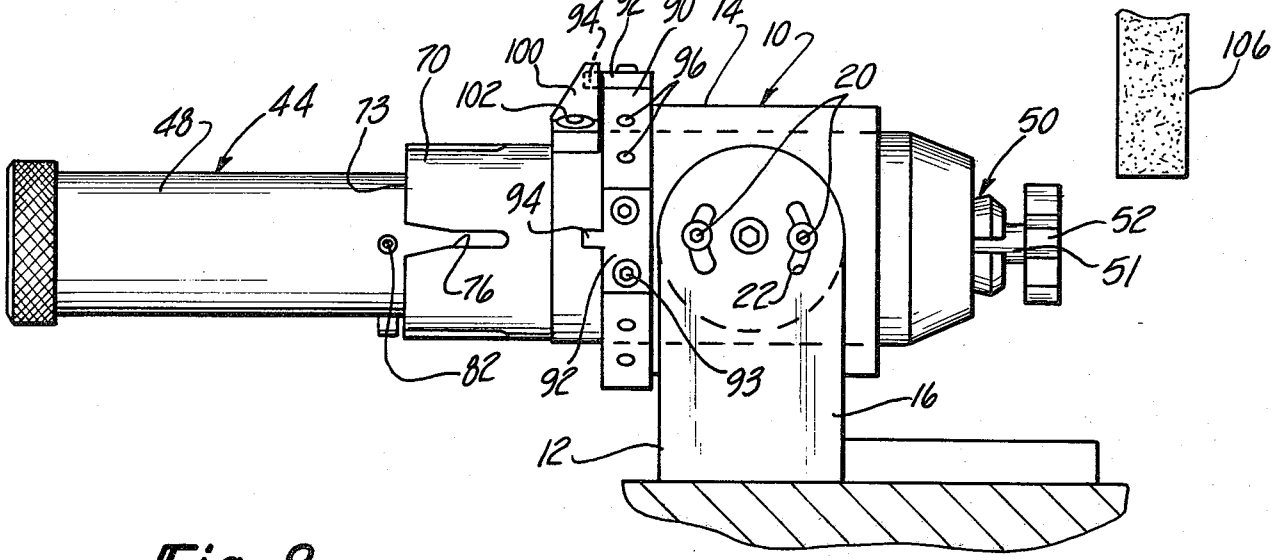
FIG. 8 is a side view similar to FIG. 2 but showing the preferred embodiment is a further operating position.

Referring now particularly to FIGS. 2, 3 and 8, an alignment pin 82 is secured to and extends radially outwardly from rear portion 48 of the elongated member 44. The alignment pin 82, moreover is dimensioned so it can fit within the slot 76 on the indexing ring 70 as is best shown in FIG. 2. With the alignment pin 82 positioned within the indexing ring slot as shown in FIG. 2, the indexing ring 70 not only limits the forward extension of the elongated member 44 into the bushing 32 but also serves to rotatably lock the elongated member 44 to the bushing 32 so that the member 44 and bushing 32 rotate in unison with each other. However, when the elongated member 44 is moved to a retracted position as shown in FIG. 8, the alignment pin 82 is rearwardly of the indexing ring slot 76 and the member 44 can rotate with respect to the bushing 32.

With reference still to FIGS. 2 and 3, a stop ring 90 is rotatably mounted to the housing body 14 adjacent its rear end. A pair of circumferentially spaced stop members 92 are secured by screws 93 to the stop ring 90 and each of these stop members 92 has an axially rearwardly extending portion 94. The stop ring 90 preferably includes a plurality of circumferentially spaced threaded bores 96 so that the stop members 92 can be circumferentially adjustably mounted to the stop ring 90. Moreover, a set screw 98 (FIG. 3) threadably engages one of these bores 96 and, upon tightening, abuts against the housing body 14 and locks the stop ring 90 in its rotationally adjusted position.

A radially extending stop tab 100 is secured by screws 102 to the rear end 36 of the bushing 32 so that a portion of the stop tab 100 is positioned in between the axially extending portions 94 of the stop members 92. The stop members 92, in conjunction with the stop tab 100 thus limit the rotation of the bushing 32 between a first and second rotational position with respect to the housing 10. The rotational limits of the bushing 32 are adjustable by merely adjusting the rotational position of the stop ring 90. In addition, the circumferential distance between the first and second rotational positions can be adjusted by merely adjusting the position of the stop members 92 along the stop ring 90.

Figure 7:
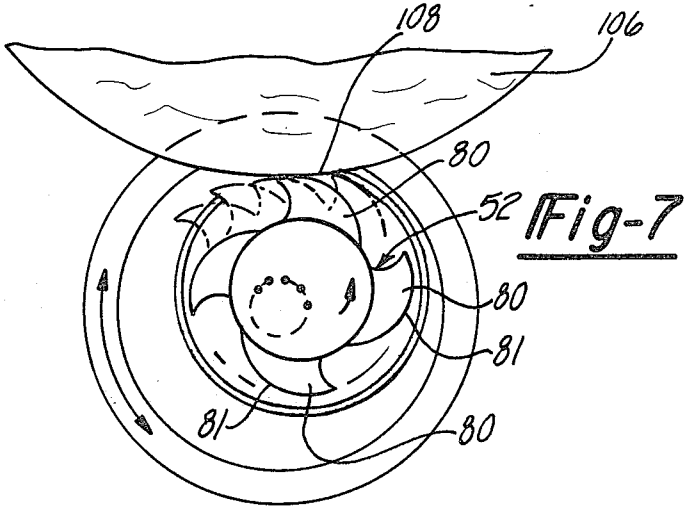
FIG. 7 is a fragmentary end view illustrating the operation of a tool grinding operation.
Figure 6:
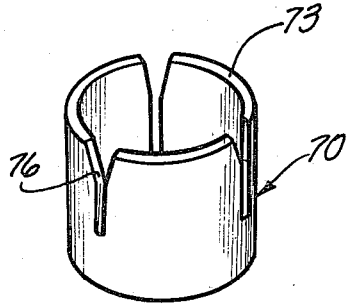
FIG. 6 is a perspective view of an indexing ring similar to FIG. 5, but illustrating a different indexing ring.
Figure 5:
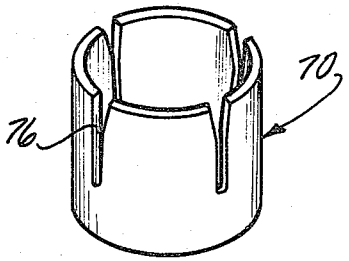
FIG. 5 is a perspective view illustrating one form of an indexing ring.

With reference now to FIGS. 2 and 7, the operation of the tool sharpening fixture of the present invention is as follows: With the cutting tool 52 mounted within the tool holding means 50 as shown in FIG. 2, the housing 10 is positioned with respect to a rotating grinding wheel 106 such that the grinding wheel 106 is radially aligned with the cutting edges 81 of the cutting tool 52 when the elongated member 44 is in its extended position. The rear portion 48 of the elongated member is then rotated along with the bushing 32 and between the rotational limits established by the stop members 92 and stop tab 100. In doing so, the grinding wheel 106 engages and sharpens the cutting edge 81 of one lobe 80 of the cutting tool 52. Furthermore, the stop members 92 on the stop ring 90 are circumferentially spaced along the ring 90 to ensure that the cutting edges 81 of only a single lobe 80 contact the grinding wheel 106 as the bushing 32 and member 44 are rotated.

When the cutting edges 81 of one lobe 80 have been resharpened in the previously described fashion, the elongated member 44 is moved to its retracted position (FIG. 8) at which time the cutting tool 52 is no longer radially aligned with the grinding wheel 106. The elongated member 44 is then rotated until the alignment pin 82 registers with the next slot 76 on the indexing ring 70 and the elongated member 44 is again moved to its extended position. Since the number of slots 76 in the indexing ring 70 corresponds to the number of cutting tool lobes 80, the next lobe 80 is then radially aligned with the grinding wheel 106. The elongated member 44 is then again rotated between its rotational limits established by the stop ring 90 thus resharpening the cutting edges 81 next lobe 80 on the cutting tool 52. This process is then repeated for each lobe 80 of the cutting tool 50 at which time the cutting tool 50 has been completely resharpened.

The eccentric throughbore 40 in the bushing 32 enables the radial relief of the cutting tools 80 to be varied as desired by simply varying the rotational position of the stop ring 90 and thus the rotational stop limits of the bushing 32. Similarly, the pivotal connection between the housing base 12 and the housing main body 14 enables the axial relief of the cutting edges 81 to be varied within the pivotal limits of the housing body 14 while maintaining the same axis of rotation for the grinding wheel 106.

From the foregoing it can be seen that the cutting tool sharpening fixture according to the present invention provides an inexpensive and yet totally effective means for sharpening cutting tools having any number of cutting lobes. Moreover, the unique indexing means not only provides a positive engagement between the indexing ring 32 and the elongated member 44 but also ensures that each lobe of the cutting tool is ground or resharpened to the same radial and axial relief. The indexing ring 32 further assures that the cutting tool 52 is completely retracted from the grinding wheel 106 as the cutting tool 52 is indexed from one lobe 80 and to the next.

A still further advantage of the tool sharpening fixture of the present invention is that both the radial and axial relief can be varied as desired to accommodate different types of cutting tools 52.

Having described my invention, however, many modifications thereto will become apparent to those skilled in the art to which it pertains without deviation from the spirit of the invention as defined by the scope of the appended claims.

I claim:

1. A tool sharpening fixture comprising:

a housing having a throughbore, a bushing having a throughbore and rotatably mounted in said housing throughbore, stop means for limiting the rotation of said bushing between two preselected rotational positions, an elongated member insertable through said bushing throughbore so that a portion of the elongated member extends outwardly from each end of the housing throughbore, a pin secured to and extending radially outwardly from one side of said elongated member, means at one end of said elongated member for holding a tool to be sharpened, and means for locking said member to said bushing at preselected rotational positions of said member with respect to said bushing, said locking means comprising an indexing ring having a plurality of axially extending slots formed through it at circumferentially spaced positions around the ring, said slots being open to one axial end of the ring, means for detachably securing the other axial end of said ring to said bushing, wherein each of said slots is dimensioned to axially slidably receive said pin therein so that, upon insertion of said pin into one of said slots, said elongated member is locked to said bushing.

2. The invention as defined in claim 1 wherein said indexing ring limits the insertion of said elongated member into said bushing throughbore.

3. The invention as defined in claim 1 and further comprising means to vary the circumferential position of said preselected rotational positions.

4. The invention as defined in claim 3 and further comprising means for varying the circumferential distance between said preselected rotational positions.

5. The invention as defined in claim 3 wherein said varying means further comprises a ring rotatably mounted to said housing and means for locking said ring to said housing at an adjusted rotational position, a pair of circumferentially spaced stop members secured to said ring and a stop tab secured to said bushing and positioned between said stop members.

6. The invention as defined in claim 5 wherein said stop members are circumferentially adjustably secured to said ring.

7. The invention as defined in claim 1 wherein said bushing throughbore is eccentric with respect to the axis of rotation of the bushing.

8. The invention as defined in claim 1 wherein said housing further comprises a base and a main body in which said bushing is rotatably mounted, and wherein said fixture further comprises means for pivotally adjustably securing said base to said main body.

* * * * *

UNITED STATES PATENT AND TRADEMARK OFFICE

CERTIFICATE OF CORRECTION

PATENT NO. : 4,341,046
DATED : July 27, 1982
INVENTOR(S) : Bernard M. Pollington It is certified that error appears in the above—identified patent and that said Letters Patent is hereby corrected as shown below:

IN THE ABSTRACT:

Line 6, delete "its", insert --it--

Signed and Sealed this

*Fifth* Day of *October 1982*

[SEAL]

*Attest:*

GERALD J. MOSSINGHOFF

*Attesting Officer*

*Commissioner of Patents and Trademarks*